US005353950A

United States Patent [19]

Taylor et al.

[11] Patent Number: 5,353,950

[45] Date of Patent: Oct. 11, 1994

[54] COLLAPSIBLE TRASH BAG DISPENSER FOR DISPENSING TRASH BAGS FROM THE BOTTOM OF A TRASH CONTAINER

[76] Inventors: Richard S. Taylor, 2798 Beach Rd., Port Huron, Mich. 48060; Dennis P. Forhan, 1025 Hayfield, Rochester Hills, Mich. 48306

[21] Appl. No.: 119,618

[22] Filed: Sep. 13, 1993

[51] Int. Cl.[5] ..... B65D 25/16

[52] U.S. Cl. ..... 220/407; 206/554; 206/390

[58] Field of Search ..... 220/407; 206/554, 390, 206/494, 812, 484, 820, 908

[56] References Cited

U.S. PATENT DOCUMENTS

| | | | |
|---|---|---|---|
| 3,392,825 | 7/1968 | Gale et al. . | |
| 3,481,461 | 12/1969 | Paxton | 206/390 |
| 3,800,503 | 4/1974 | Maki | 53/390 |
| 4,201,029 | 5/1980 | Lerner | 206/494 |
| 4,319,694 | 3/1982 | Nehrbass et al. | 220/407 |
| 4,349,123 | 9/1982 | Yang | 220/407 |
| 4,506,801 | 3/1985 | Origuchi | 206/390 |
| 4,712,684 | 12/1987 | Boeckmann | 206/494 |
| 4,721,226 | 1/1988 | Yurko | 220/407 |
| 4,805,800 | 2/1989 | Nocek et al. | 206/554 |
| 4,850,507 | 7/1989 | Lemongelli et al. | 220/407 |
| 4,863,064 | 9/1989 | Dailey, III | 206/494 |
| 4,869,391 | 9/1989 | Farrington | 220/407 |
| 4,955,505 | 9/1990 | Battaglia | 220/407 |
| 5,000,340 | 3/1991 | Leggio | 220/407 |
| 5,115,935 | 5/1992 | Lemongelli | 220/407 |
| 5,183,157 | 2/1993 | Darden | 206/390 |
| 5,242,057 | 9/1993 | Cook et al. | 206/494 |

*Primary Examiner*—S. Castellano

*Attorney, Agent, or Firm*—Charles W. Chandler

[57] ABSTRACT

A flexible, collapsible trash bag dispenser is attached to the bottom of a trash can by an adhesive tape. The trash bags are connected in a string and stored in the dispenser with the last bag being connected to the pouch. The trash bags are pulled out one at a time, and expanded in the container. When the expanded trash bag is full of trash, it is removed from the container, pulling up the next bag to replace the full trash bag. The process continues until the last bag, which is marked, indicates the end of the string of bags. The last trash bag is attached to the pouch so that they can be removed together when the last trash bag is full. The flexible pouch is collapsed as trash is delivered into the bag.

3 Claims, 2 Drawing Sheets

COLLAPSIBLE TRASH BAG DISPENSER FOR DISPENSING TRASH BAGS FROM THE BOTTOM OF A TRASH CONTAINER

BACKGROUND OF THE INVENTION

Trash bag dispensers are commonly employed for storing a string of folded trash bags which are individually removed from the dispenser. Typically the trash bag dispenser is stored in a location remote from the trash can so that it is difficult to locate the dispenser to replace a full trash bag. Several patents have been issued for trash bag dispensers including U.S. Pat. No. 4,349,123 which was issued Sep. 14, 1982 to Yih-Chen Yang; U.S. Pat. No. 4,721,226 which was issued Jan. 26, 1988 to Edward P. Yurko; U.S. Pat. No. 5,115,935 which was issued May 26, 1992 to Ralph J. Lemongelli; U.S. Pat. No. 3,392,825 which was issued Jul. 16, 1968 to John A. Gale et al; U.S. Pat. No. 4,955,505 which was issued Sep. 11, 1990 to Michael A. Battaglia; U.S. Pat. No. 3,800,503 which was issued Apr. 2, 1974 to Robert G. Maki; U.S. Pat. No. 4,319,694 which was issued Mar. 16, 1982 to Joel M. Nehrbass et al; U.S. Pat. No. 4,850,507 which was issued Jul. 25, 1989 to Ralph J. Lemongelli et al; and U.S. Pat. No. 4,869,391 which was issued Sep. 26, 1989 to Prince D. Fartington.

SUMMARY OF THE INVENTION

The broad purpose of the present invention is to provide a collapsible trash bag pouch for storing a string of folded trash bags. The pouch is placed in the bottom of the trash can and preferably releasably connected to the trash can by an adhesive tape. The pouch has a perforated section which is opened to provide an opening for individually removing the trash bags from the pouch. When a trash bag is removed from the pouch, it is expanded in the trash can above the pouch. The weight of trash received in the bag collapses the pouch. A full trash bag is then removed from the trash can, pulling up the next bag, making it easy to open and place in position above the pouch. This process continues until the last full bag removes the pouch with it. The process is repeated then with a new pouch.

The collapsible pouch provides a convenient way for storing the trash bags until they are to be used.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
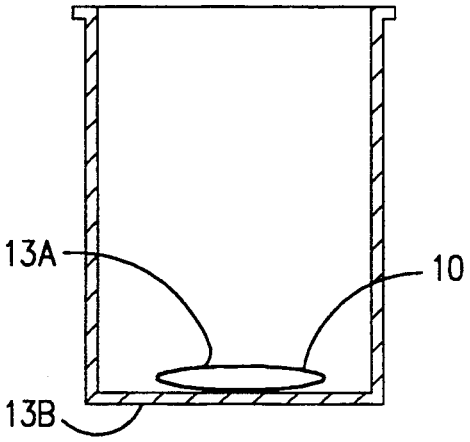
FIG. 1 is a sectional view through a trash can illustrating a pouch embodying the invention.
Figure 2:
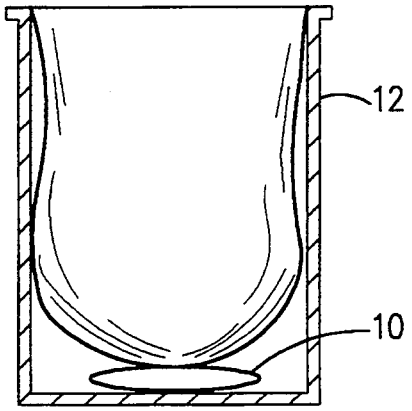
FIG. 2 is a sectional view of a bag open for use on top of the pouch.
Figure 3:
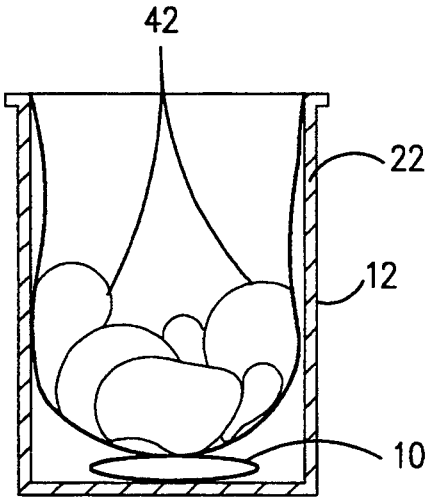
FIG. 3 is a view illustrating the manner in which the weight of trash emptied into the bag collapses the pouch.
Figure 4:
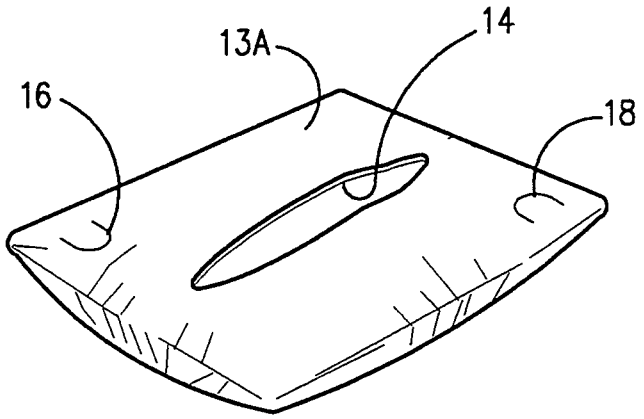
FIG. 4 is an enlarged view of the pouch showing the top opening.

Referring to the drawings, a trash bag pouch 10 is illustrated in FIGS. 1–3 mounted in the bottom of a conventional trash container 12. Referring to FIG. 4, pouch 10 is preferably formed of a pair of flexible plastic 4-sided panels 13A and 13B attached together around their edges. For illustrative purposes the pouch is about 8 inches long, 2 inches high and 8 inches wide in its' expanded, condition. The bag has a top opening 14 providing access to internal compartment 15. The bag is manufactured with a series of perforations about 5 inches long which the user tears to form opening 14 for withdrawing an individual bag. The top panel of the pouch has a pair of ¼ openings 16 and 18 for passing air from the pouch when it is being collapsed.

Figure 5:
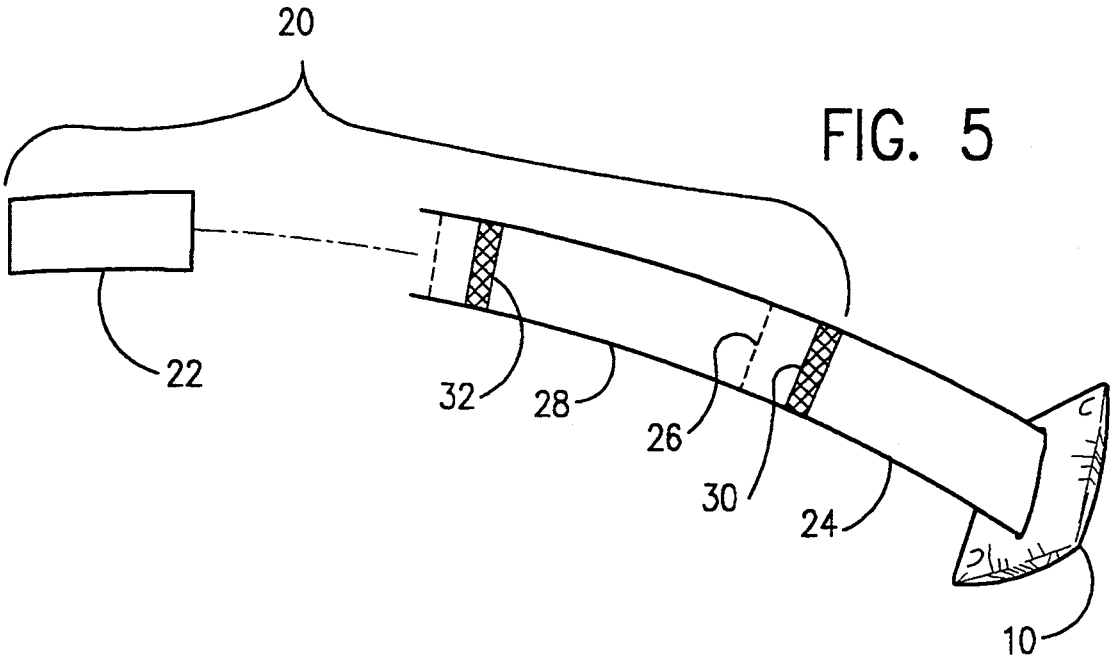
FIG. 5 is a view showing the manner in which a string of bags may be removed from the pouch.

Referring to FIG. 5, a string of bags, collectively illustrated at 20, are stored in the pouch. The string includes a first bag 22 and a last bag 24. Each individual bag is connected to the adjacent bags by a line of perforations 26 in a manner well known to those skilled in the art. The outermost bag is torn from the next bag along a line of perforations.

The trash bags are conventional and may take any size suitable for the trash container. The last two bags 24 and 28 are marked with color coated strips 30 and 32 to indicate to the user that a refill dispenser will soon be necessary.

Figure 6:
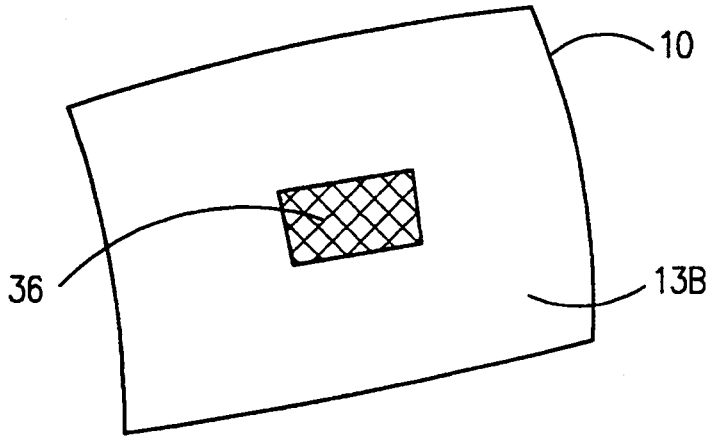
FIG. 6 is a view of the bottom of the pouch.

Referring to FIG. 6, the bottom panel 13B of the pouch carries adhesive tape 36 which is used, as illustrated in FIG. 3, for releasably attaching the pouch to the bottom of the trash container.

Figure 7:
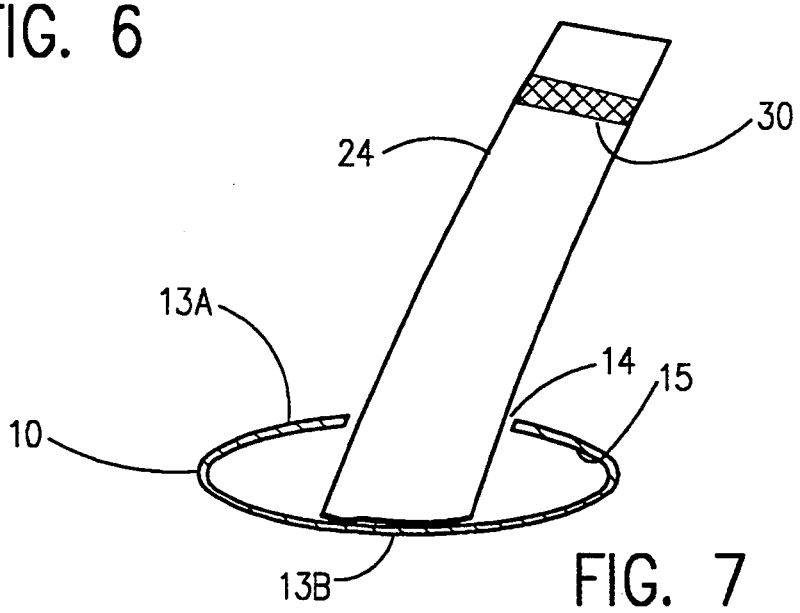
FIG. 7 is a sectional view of the pouch showing the last bag connected to the pouch.

Referring to FIG. 7, the last bag 24 is attached at 40 to the inside bottom of the pouch by any suitable means such as an adhesive. The attachment permits the pouch to be removed from the container with the last full bag, but connects the pouch to the container when each full bag, except for the last bag, is being removed from the container.

In use, the pouch is mounted in the bottom of the trash container as illustrated in FIG. 1. First bag 22 is then removed through pouch opening 14, and expanded in the conventional manner as illustrated in FIG. 2. Trash, generally indicated at 42, is delivered into the trash bag. The weight of the trash then partially collapses the pouch depending upon the number of bags remaining in the pouch, by passing any air in the bag through openings 16 and 18.

When trash bag 22 is full, it is then removed from the container, pulling up the second bag from the pouch. The user then tears the first full bag from the second empty bag and expands the empty bag in the trash container in the usual manner. The top opening in the full bag is then tied in the conventional manner.

Having described our invention, we claim:

1. A trash bag dispenser for use in a trash container, comprising:

a collapsible trash bag pouch having an internal compartment with an opening;

a plurality of trash bags detachably connected to one another to form a string of bags including a first bag at one end of the string, and a last bag at the opposite end of the string, the plurality of bags being disposed in the internal compartment of the pouch, each trash bag being individually removable through the pouch opening to an expanded position in the trash container for receiving trash;

means attaching the last bag to the interior of the pouch to prevent the separation of the last trash bag from the pouch but permitting the other trash bags to be individually removed from the pouch;

adhesive means for releasably connecting the pouch to the bottom of the trash container, such that the connection between the pouch and the container is weaker than the attachment between the pouch and the last bag to prevent removal of the last bag from the pouch;

whereby the weight of one of the bags from the pouch and expanded in the trash container collapses the pouch by substantially removing all the air from the pouch.

2. A trash bag dispenser as defined in claim 1, in which the last bag has indicia indicating to a user that there are no remaining trash bags in the pouch.

3. A trash bag dispenser as defined in claim 1, in which the last bag is so attached to the pouch that the pouch is removable with the last bag by pulling the last bag out of the container.

* * * * *